United States Patent [19]

Scott

[11] 4,261,506

[45] Apr. 14, 1981

[54] RECLOSABLE BAG

[75] Inventor: Raymond G. Scott, Oak Brook, Ill.

[73] Assignee: Champion International Corporation, Stamford, Conn.

[21] Appl. No.: 113,759

[22] Filed: Jan. 21, 1980

[51] Int. Cl.[3] ..... B65D 33/30

[52] U.S. Cl. ..... 229/65; 206/806; 229/54 R

[58] Field of Search ..... 229/65, 54 R; 206/806; 150/12

[56] References Cited

U.S. PATENT DOCUMENTS

| | | | |
|---|---|---|---|
| 2,041,375 | 5/1936 | Schmerler | 229/65 |
| 3,545,668 | 12/1970 | Hultberg | 229/65 |

*Primary Examiner*—Stephen P. Garbe

*Attorney, Agent, or Firm*—Evelyn M. Sommer

[57] ABSTRACT

A reclosable bag having front and back panels and an open end or mouth adaptable to be reclosabe. A non-resiliently deformable label or strip, such as a metal-foil strip, is bonded to one of the panels adjacent to the open end. The label is of sufficient width so that when the mouth end of the bag is folded upon itself, the bag will maintain the folded configuration. The label is adapted to be folded about its transverse axis to form a multi-layer rectangular structure when the mouth end of the bag is folded upon itself. The label has a U-shaped slit with the open end of the slit terminating at the transverse axis. When the label is folded about the axis, the segment of the label outlined by the U-shaped slit extends beyond the folded edge of the label and bag to form a tab. The tab is provided with an opening thereby permitting the bag to be hung on a rack.

3 Claims, 4 Drawing Figures

RECLOSABLE BAG

BACKGROUND OF THE INVENTION

1. Field of the Invention

This invention relates to a reclosable bag. In its more specific aspect, this invention relates to a reclosable bag utilizing a closure capable of maintaining a folded configuration and an integrally connected hang tab.

2. Prior Art

The prior art relating to reclosable containers discloses many types of closure means for bags, containers, overwraps, and the like that enables one to open and close the bag, at will, after the bag has been originally opened and the seal broken. Such bags are known in the art as reclosable bags, and are particularly useful when only a portion of the contents are removed, such as by a consumer when the bag contains food. Also, such bags are useful to protect the contents from spoiling and from unsanitary conditions, such as in the case of food.

One common construction for such reclosable bags is what is known in the art as the "tin-tie", which consists of a metal strip or wire encased in light paper or plastic. The tin-tie is then affixed to one panel edge of the open end or mouth of the bag, but is of sufficient length to extend laterally beyond the width of the bag. After the bag has been filled with the desired contents, the tin-tie is folded longitudinally, usually two or three times, and the extensions of the tin-tie are folded laterally to interengage the opposed panel of the bag, thereby securing the bag shut. This type of closure requires separate handling and operations, and therefore it is costly and time-consuming.

Other bags use a pressure sensitive seal. For example, the bag may be folded longitudinally upon itself, as for example with two ⅝-inch folds, and a label having a gummed surface is affixed to the bag at the fold so as to prevent unfolding. The adhesive permits repeated bonding and release. Such labels, however, tend to lose their tackiness and therefore become ineffectual. Other reclosable containers include a metal strip or metal label, which may be encased between two plys, as in a paper-plastic laminate, and when folded about itself or a panel of the bag, the bag is held in a closed position.

Accordingly, it is an object of this invention to provide a bag structure that can be opened and closed numerous times, and still maintain its closed configuration along the entire length of its mouth.

It is another object of this invention to provide a reclosable bag utilizing a closure means with an integrally formed hang tab.

SUMMARY OF THE INVENTION

Broadly, my invention comprises a reclosable bag having front and back panels and an open end or mouth adaptable to be reclosable. A nonresiliently deformable label or strip, such as a metal-foil strip, is bonded to one of the panels adjacent to the open end. Preferably, the top edge of the label is flush with the marginal edge of the panel at the mouth, and the label extends substantially the full width of the panel. Also, the label is of sufficient height in its longitudinal dimension so as to be folded longitudinally when the mouth end of the bag is folded upon itself. Desirably, the height of the label is sufficient such, that when the bag is closed, two folds approximately ⅝-inch in height are formed. The label is not particularly resilient, although flexible, and will maintain the folded configuration so as to keep the bag in a closed position. The label is adapted to be folded about its transverse axis, which preferably is in about the middle of the label, to form a multilayer rectangular structure when the mouth end of the bag is folded upon itself. Further, the label is provided with a U-shaped slit with the open end of the slit terminating at the transverse axis. When the label is folded about the axis, the segment of the label outlined by the U-shaped slit extends or protrudes beyond the folded edge of the label and bag to form a tab. The tab is provided with an aperture or opening thereby permitting the bag to be hung on a rack.

The thickness of the bag materials and label shown herein are exaggerated for purposes of clarity of illustration.

DESCRIPTION OF ILLUSTRATED EMBODIMENTS

Figure 1:
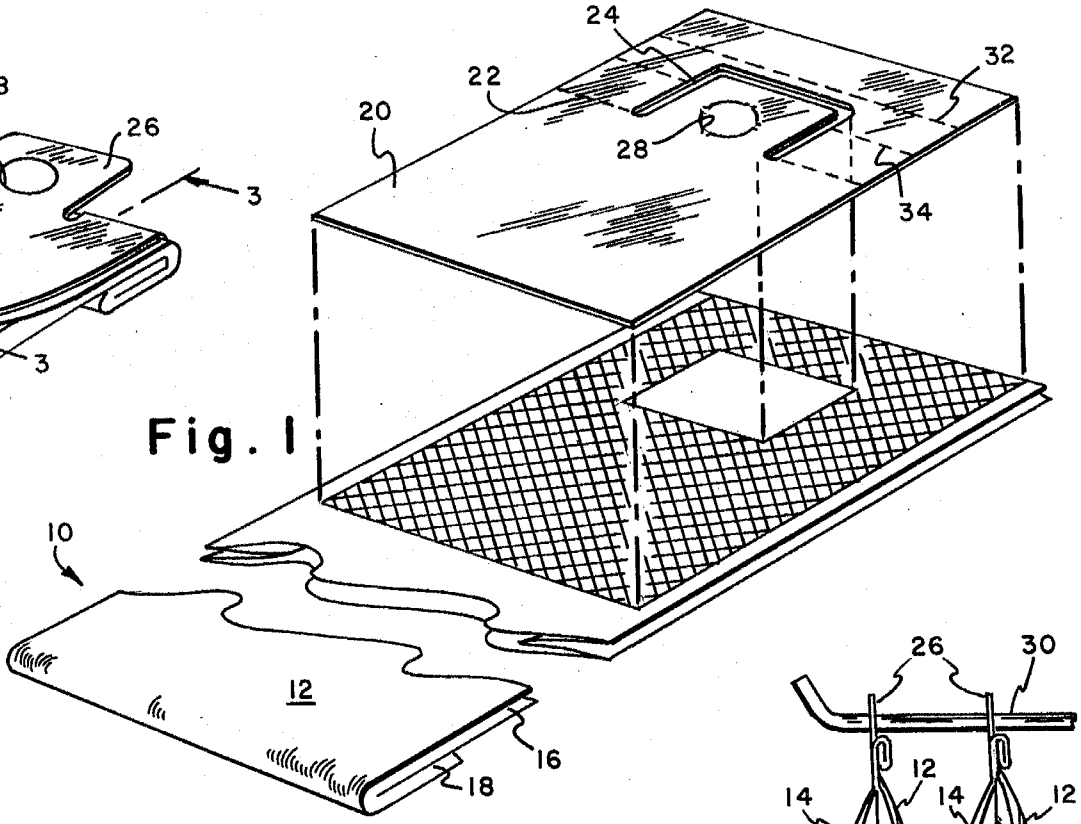
FIG. 1 is a perspective exploded view of a reclosable bag constructed in accordance with the principles of the present invention.

Referring to the drawings wherein like reference numerals refer to the same parts throughout, there is shown in FIG. 1 a bag indicated generally by the numeral 10 and, typically, is constructed of an opaque material such as paper or paper-plastic laminate, but, where desired, may be formed of a transparent or transluscent material such as Cellophane. The bag comprises a front panel 12 and back panel 14 joined together at their longitudinal sides with gusset panels 16. Further, the bag is closed at the bottom edge by any conventional means, such as with a gummed surface which is folded upon itself at 18 and sealed. The opposite end or top of the bag is opened at the upper edges to define the mouth of the bag which is to be opened and closed.

In accordance with the present invention, there is provided a rectangular strip or label 20 of flexible metal, such as aluminum foil. The under surface of the label is provided with an adhesive, and the label is bonded over most of its area to the outer facing of panel 12. (See FIG. 1.) It will be observed that the lateral dimension of the label is such that the width is substantially the width but not beyond the width of panel 12, or, where desired, may be slightly less but sufficient to overlay the apices of the side gussets so that the bag is held closed along the entire length of the mouth when the surfaces are folded, as described below in greater detail. Also, it is preferred to place the label on the panel such that the top edge of the label is essentially flush with the marginal edge of the mouth.

Figure 2:
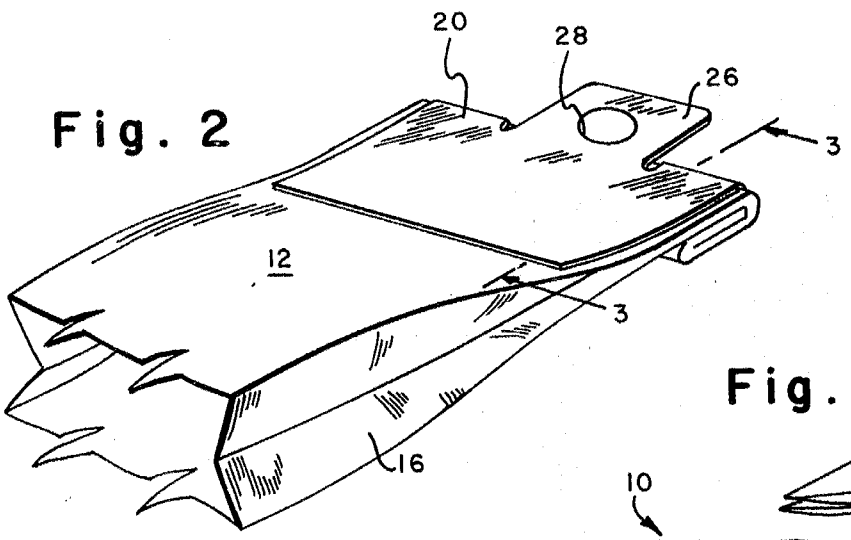
FIG. 2 is a fragmentary perspective view of the mouth end of the bag showing the bag closed.
Figure 3:
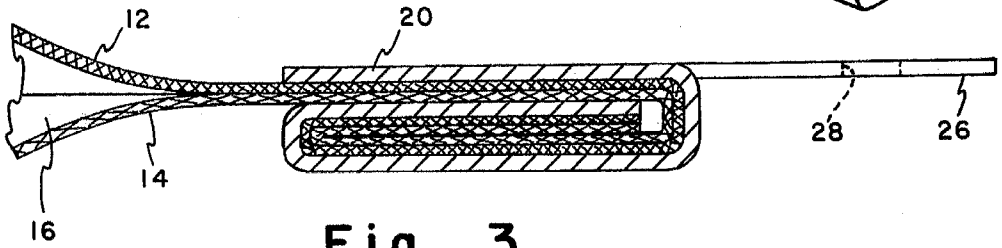
FIG. 3 is a sectional view on line 3—3 of FIG. 2 showing in detail the folded mouth but with the hang tab folded outwardly so that the bag can be hung on a rack.

The label, being flexible, is adapted to be folded on its transverse axis indicated by the line 22, which preferably is about in the middle of the length of the label. When the mouth end of the bag is folded upon itself, the label, also being folded, forms a multi-layer rectangular structure (see FIGS. 2 and 3). The label is provided with a substantially U-shaped slit 24 with the open end of the slit terminating at the transverse axis 22. It will be observed that the area outlined by the U-shaped slit is not bonded to the surface of the panel 12. This area, therefore, is an unbonded area surrounded by a bonded area. When the label is folded about the transverse axis, the segment of the label outlined by the U-shaped slit extends beyond the folded edge of the label and bag thereby forming an upstanding tab 26 integrally formed with the label. The tab 26 is provided with an opening 28 which is positioned in about the middle of the tab. In this manner, the bag can be hung on a rack 30.

The height or longitudinal dimension of the label is sufficient to provide approximately two or three folds of about $\frac{5}{8}$-inch each above the transverse axis 22, but slightly smaller or larger folds may be used where desired. The important feature is that each fold should be of sufficient depth so as to maintain its folded configuration thereby retaining the bag in a closed position. For example, two $\frac{5}{8}$-inch folds are quite satisfactory for most bags of tubular shape designed to hold about twelve ounces of contents. In order to facilitate folding, the label may be provided with indicia 32 and 34.

In accordance with the invention, hang tab 26 is integrally connected to the label 20 along the transverse axis 22 which serves as a hinge line and extends longitudinally from the label beyond the edge of the fold. The hang tab is of substantially less width than the label, and is designed to lie essentially flat on the facing of panel 12 when the label is first bonded to the panel, but is not adhered thereto when the label is affixed or bonded to the panel. Also, the hang tab is provided with an opening 28 so that the bag can be hung on a rack.

In carrying out the invention, the label is bonded to the front panel 12 of the bag on the exterior surface thereof in the area 28. The U-shaped segment, however, is not bonded to the panel surface, as explained above. The bag is then filled or otherwise provided with contents. The bag at the mouth end is then folded first along the indicia 32 so as to bring a fold of the back panel 14 into face-to-face contact, and then folded along the indicia 34 to bring the label into face-to-face contact with the back panel 14. (See FIG. 3).

Figure 4:
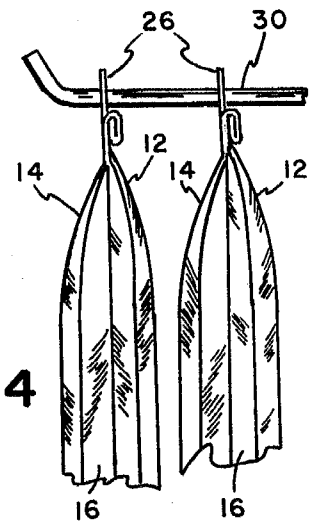
FIG. 4 is a fragmentary side elevational view showing the bag of FIG. 2 hanging from a rack.

The bag is opened, as by the consumer, in reversing the procedure, and then reclosed with the same procedure to protect any of the unused contents. Hang tab 26 is folded outwardly from panel 12 along the hinge line or transverse axis 22 so as to extend longitudinally from the bag above the edge of the fold. It will be observed in FIG. 3, that the hang tab 26 protrudes or extends beyond the upper edge of the folded-over bag, and the opening 28 is positioned to be above this same upper edge. The bag then can be hung on a rack 30 as shown in FIG. 4.

We claim:

1. A reclosable bag comprising (a) a substantially tubular body closed on three sides and having front and back panels and an open end, (b) a nonresiliently deformable metal label bonded over most of its area to the outer face of one of said panels adjacent to the open end of said bag flush with the marginal edge of said panel and extending substantially the full width but not beyond the width of the open end of said bag, said label adapted for folding about its transverse axis to form a multi-layer rectangular structure when the mouth end of said bag is folded upon itself, said transverse axis positioned about midway to longitudinal length of said label, (c) said label having a substantially U-shaped slit therein with the open end of said U-shaped slit terminating at said transverse axis to outline an unbonded area of said metal label surrounded by a bonded area; whereby upon folding said label about said axis, the segment of said label outlined by said U-shaped slit is extended beyond said folded label to form a tab extending from said multi-layer structure, and (d) said tab having an opening thereby permitting said bag to be hung on a rack.

2. A reclosable bag according to claim 1 wherein said metal label is aluminum foil.

3. A reclosable bag according to claim 1 wherein said metal label is lead foil.

* * * * *